United States Patent [19]

Lou

[11] 4,170,880

[45] Oct. 16, 1979

[54] WINDOW TYPE AIR CONDITIONER WITH SAND AND DUST PRECLUSIVE MEANS

[76] Inventor: Kwong-Li Lou, 8-2, Ln. 227, Nan-Men Rd., Tainan, Taiwan, 700

[21] Appl. No.: 917,636

[22] Filed: Jun. 21, 1978

Related U.S. Application Data

[63] Continuation-in-part of Ser. No. 767,677, Feb. 11, 1977, abandoned.

[51] Int. Cl.[2] ..... F25D 23/12; E06B 7/02

[52] U.S. Cl. ..... 62/262; 98/94 AC

[58] Field of Search ..... 62/262, 507, 265, 298, 62/531, 297; 98/94 AC; 312/236

[56] References Cited

U.S. PATENT DOCUMENTS

| | | | |
|---|---|---|---|
| 2,660,866 | 12/1953 | Tipton et al. | 62/262 |
| 2,826,472 | 3/1958 | Humphner | 62/262 |
| 2,842,199 | 7/1958 | Pfeiffer | 62/262 |
| 3,165,053 | 1/1965 | Christie | 98/94 AC |

*Primary Examiner*—Lloyd L. King

*Attorney, Agent, or Firm*—Oblon, Fisher, Spivak, McClelland & Maier

[57] ABSTRACT

A window type air conditioner having a movable shield member installed on the air conditioner outer case at the rear radiator compartment portion thereof, to either block the ventilation passageways provided at the rear portion when the air conditioner is not in use, or to admit air to the air conditioner when the air conditioner is in use. The shield member can be either slidably, pivotably or rollably moved relative to the air conditioner ventilation passageways, and can be manually or electrically actuated.

15 Claims, 11 Drawing Figures

WINDOW TYPE AIR CONDITIONER WITH SAND AND DUST PRECLUSIVE MEANS

CROSS REFERENCE TO RELATED APPLICATIONS

This application is a continuation-in-part application of U.S. patent application Ser. No. 767,677 filed Feb. 11, 1977 and now abandoned.

BACKGROUND OF THE INVENTION

1. Field of the Invention

The present invention relates generally to window type air conditioners.

2. Description of the Prior Art

In existing window type air conditioners having an outer case, the rear portion of the case which shields the radiator and fan compartment is provided with slots for ventilation. However, window type air conditioners in normal homes are not used all twenty four hours and not all year, especially in sub-tropic areas where window type air conditioners are only used for cooling during the summer, and are not used in winter when the weather is too cold to require air conditioning. Sand and dust are easily blown in and accumulated in the radiator and fan compartment through the ventilation slots of the rear case during windy days, thereby shortening the air conditioner service life and resulting in frequent cleaning and lubrication thereof. Actually, it is not necessary to let sand and dust blow into the air conditioner on windy days, especially when it is not in use. Furthermore, window type air conditioners are usually installed in high places and the radiator portion is in the outside air, therefore to cover it with some water proof material for protection or to remove and reinstall it for cleaning is quite inconvenient.

SUMMARY OF THE INVENTION

It is therefore one object of the present invention to provide an improved case for a window type air conditioner wherein the ventilation passageways on the rear portion of the air conditioner are opened and closed.

The object of the present invention is achieved by an outer case on a window type air conditioner having a shield member slidably, pivotably or rollably installed at the ventilation portion. The shield member is actuated at the front panel by means of a link mechanism or electrical actuating devices.

An air conditioner power switch is actuated in response to opening and closing of the shield member, such that when the power is on, the shield member must be opened.

Many known actuating electrical devices, for instance, a motor set with terminal stop switches, or an electromagnet set, with some special arrangement can be employed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
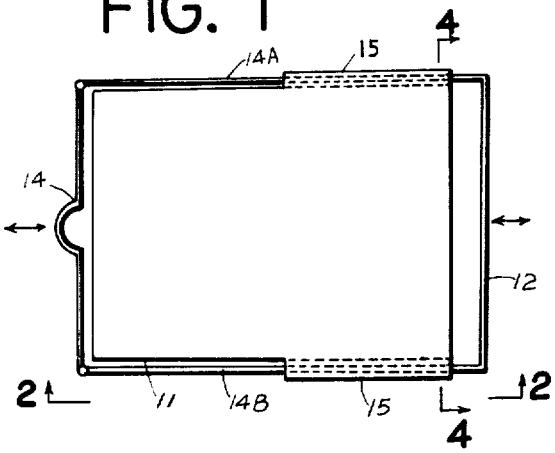
FIG. 1 is a top elevational view of a window type air conditioner showing the rear ventilation portion of an air conditioner outer case having a U-shaped double shield case slidably mounted exterior to the rear ventilation portion and operated by a handle at the front panel through links, with arrows indicating sliding directions, and the U-shaped shield case in the open position.

Referring now to the drawings, wherein like reference numerals designate identical or corresponding parts throughout the several views, and more particularly to FIGS. 1-4 thereof, the outer case 11 of a window type air conditioner has a U-shaped shield 12 slidably installed at a rear ventilation portion wherein radiator and fan are located. The U-shaped shield 12 has ventilation slots 13 correspondingly dimensioned to the air conditioner ventilation passageways which exist on the outer case rear portion, only positions of the shield passageways are intercrossed with respect to the air conditioner ventilation passageways.

A handle 14 is mounted on the front panel of the air conditioner and is linked to the U-shaped shield 12 by side links 14A and 14B which may be installed at various places.

On the outer case 11 rear portion, slide-ways 15 and 16 are provided at both sides upper and lower edges for adopting the U-shaped shield 12 whose side edges are folded in matched slidable configuration. The slide-ways may be provided at upper and middle of both sides, or upper edges only, because the lower case area rusts easily making the shield article unslidable.

By operating the handle 14, the U-shaped shield 12 is slidable in the slide-ways 15 and 16 between forward and rearward limits. When the handle 14 is pushed rearwardly and the U-shaped shield 12 is moved to a rearward limit, the U-shaped shield 12 rear side wall moves away from the outer case 11 rear wall, and its two side ventilation slots coincide with the ventilation slots on the outer case 11, therefore the ventilation louvers of the outer case 11 are clear to the outside. When the U-shaped shield 12 is pulled to a forward limit position by the handle 14, its rear side wall is fully contacting the outer case 11 rear wall, and both side ventilation slots are closed by each other, therefore the ventilation of the outer case 11 rear portion is closed.

The existing ventilation slots are made by cutting the case wall into strips and twisting each strip about ninety degrees for opening and reinforcing its structure. In the present invention, the ventilation slots may be made by cutting the case wall into strips and folding two edges of each strip at one face to form a slot with the other face flat for contacting and sliding.

Figure 2:
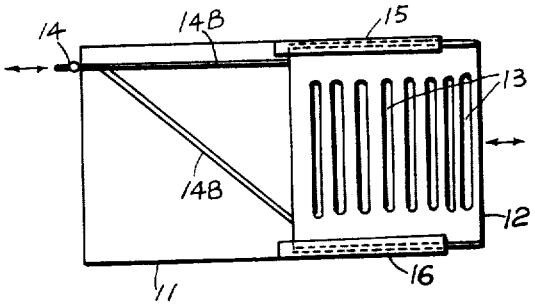
FIG. 2 is a side view taken in the plane indicated by line 2—2 in FIG. 1, showing the U-shaped shield case linked to the operating handle.
Figure 6:
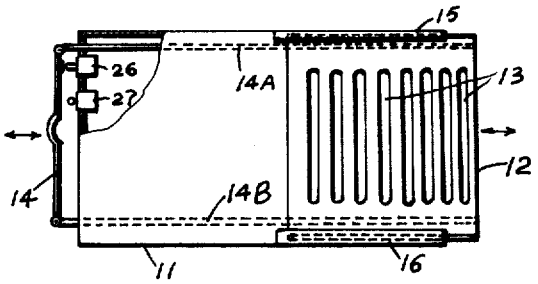
FIG. 6 is a side view similar to FIG. 2, showing an auxiliary power switch actuated by the handle when the U-shaped shield member is pushed to a rearward limit position, and an adjacent main power switch, with the outer case partially removed and electrical wiring omitted for viewing clarity.

The handle 14 in FIGS. 1 and 2, may also actuate a power switch so that when the handle actuates the U-shaped shield to the open or closed position, it also actuates the power switch to the power on or off position correspondingly, as shown in FIG. 6. A power switch 26 on the front panel is actuated to the on position by the handle 14 as the handle is pushed rearwardly, meanwhile the U-shaped shield 12 is pushed rearwardly to the open position. On the contrary, when the handle 14 is pulled to the forward position, the handle 14 leaves the switch 26 which then returns to the off position, meanwhile the U-shaped shield 12 is pulled forwardly to close the rear outer case 11. When the power switch is at the on or the off position the air conditioner is operated or stopped, respectively.

Furthermore, the power switch 26 may be an auxiliary switch which is electrically connected to the existing main power switch 27 in series circuit, so that when the U-shaped shield 12 is pushed rearwardly to the open position, the auxiliary switch 26 is actuated to the power on position, the air conditioner then operates the same as a conventional air conditioner, and is further operated by the main power switch 27. When the U-shaped shield is actuated to a closed position, the auxiliary switch 26 is actuated to the off position, the air conditioner is stopped, even though the existing main power switch 27 is still at the on position due to the series circuit.

Figure 4:
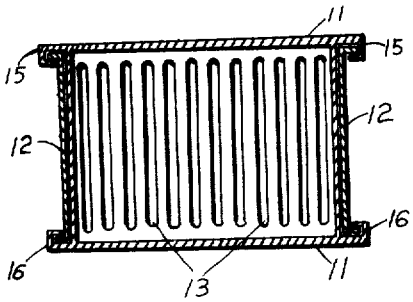
FIG. 4 is a sectional view taken in the plane indicated by line 4—4 in FIG. 1, with the air conditioner radiator omitted therefrom for view clarity, showing the rear portion of the outer case having ventilation slots at the rear, and slide-ways at both sides at the top and bottom edges wherein the U-shaped shield case is slidably mounted.
Figure 7:
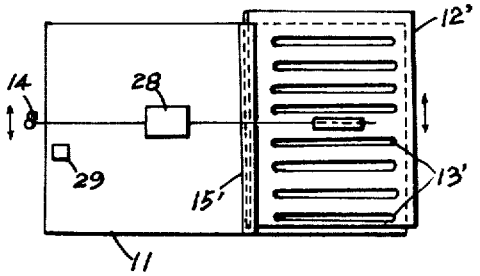
FIG. 7 is a view of a modification of FIG. 2, showing an air conditioner having horizontal ventilation slots and the U-shaped shield member modified to slide vertically by means of a conventional linkage means.

The shield 12 and linkage means as shown in FIGS. 1, 2 and 4 can be modified in various ways, for example:

(1) The U-shaped case 12 in FIGS. 1, 2 and 4 can be installed at the inside of the outer case 11 rear portion, instead of at the outside;

(2) The U-shaped shield 12 can be modified to be slidable along an up and down direction, instead of forward and rearward direction, with ventilation slots made in horizontal position, and the linkage means between the front handle and the U-shaped shield modified to a conventional lever set or bell-crank or the like, as shown in FIG. 7. The U-shaped shield 12' has level slots 13'. The slots at the outer case 11 rear portion are also horizontally modified accordingly. The U-shaped shield 12' is slidable up and down for a travel equal to one slot width along vertical slideways 15' at both sides, and is linked to front handle 14 at two sides by two conventional link sets 28 with fulcrums secured on both sides of the outer case 11. A conventional holding article 29, in any desired feature, is at the outer case 11 for holding the link set 28 at a lower position when required.

When the handle 14 is pressed downwardly, by fulcrum action, the rear portion of the link set 28 lifts the U-shaped shield 12' which slides upwardly along slideways 15'. The forward portion of the link set 28 is held by using the conventional holding article 29, and thereby the U-shaped shield stays at the upper open position. Release of the holding article 29 moves the front portion of the link set 28 upwardly, the U-shaped shield 12' then slides down to the original closed position. As stated above, the up and down positions only need one slot width distance, so by proper arrangement one position is in open and the other is closed.

Figure 5:
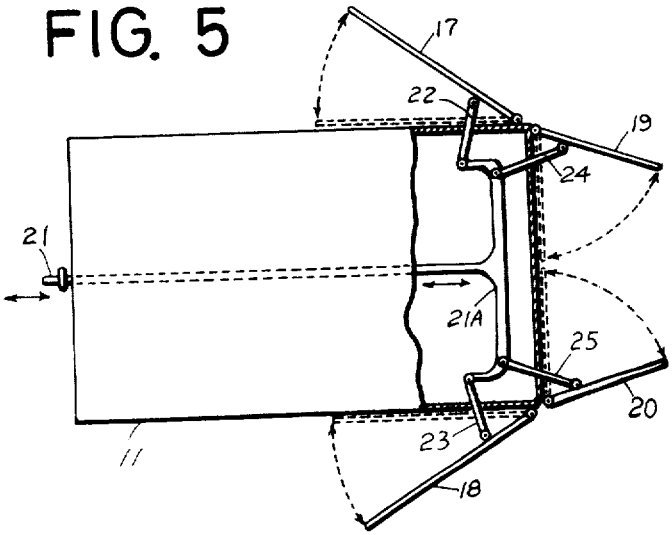
FIG. 5 is a modification of FIG. 1, showing the U-shaped shield case being replaced by four pivotable shield plates to close and open the ventilation portion, with a portion of outer case removed for showing the inside operating lever connection.

(3) FIG. 5 shows another embodiment of the present invention. Four shield plates 17, 18, 19 and 20 without ventilation slots replace the slidable U-shaped shield 12 and are pivotally provided at the outer case 11 rear edges. Plates 17 and 18 cover both side wall ventilation slots, and plates 19 and 20 serve as double doors for covering the rear wall ventilation slots of the outer case 11. With lever means, links 22, 23, 24 and 25 connect the shield plates 17, 18, 19 and 20 respectively together to link 21A which is connected to the operating handle 21 at the front control panel. The dimension and configuration of these links are so designed that as the handle 21 moves forwardly or rearwardly, the shield plates 17, 18, 19 and 20 together will pivot accordingly, as shown by the arrows and the dot lines in FIG. 5, to close or open the ventilation areas of the outer case 11.

(4) The pivotable shield plates as described in the above paragraph (3) can be modified in different numbers and in different pivoting orientations.

(5) The pivotable shield plates as described in above paragraph (3) can be installed on a shelf instead of on the outer case 11, to be an individual assembly which is sleeved and mounted onto the outer case 11 rear portion and provided with link means also controlled from the front control panel.

(6) The above described operational means are all manual. They can also be modified to be electrically operated. For instance, (A) a motor driving means on the outer case with a control switch at front control panel, and limit switches at each travel stop of the shield member; (B) an electromagnetic mechanism on the outer case connected to the shield member with a switch at the front control panel, for pushing and pulling by electromagnetic force when the switch is actuated. Many known arts can be used, and in FIG. 8 and FIG. 9 are shown two simple cases.

Figure 8:
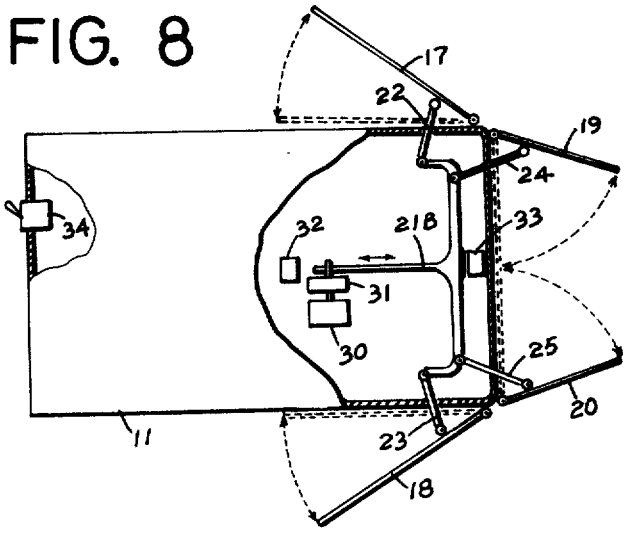
FIG. 8 is a view of a modification of FIG. 5, showing electrical means for actuating the shield member, with part of the outer case removed and electrical wiring omitted for viewing clarity.

FIG. 8 is based on FIG. 5 and the door-like shield members are operated by a reversible motor 30 and limited by two limit switches 32 and 33 installed on the outer case 11 rear portion. By any known linkage mechanism 31, the motor 30 is linked to and drives a master link 21B which links to door-like shield members the same as 21A in FIG. 5. The clockwise and counter-clockwise rotation of the motor 30 drives the master link 21B forwardly and rearwardly, or leftwardly and rightwardly per viewer's direction, and pivots the door-like shield members to closed and open positions accordingly. The forward and rearward moving of the master link 21B is stopped upon meeting and actuating the limit switches 32 and 33 at forward and rearward travel terminals.

The power supply to the motor 30 is controlled by a switch 34 at the front panel. The switch 34 is double-throw type, and has three positions in which the center is off and the both sides are for clockwise and counterclockwise motor rotation and are electrically connected to the motor 30 and two limit switches 32 and 33 in series circuit respectively.

Figure 9:
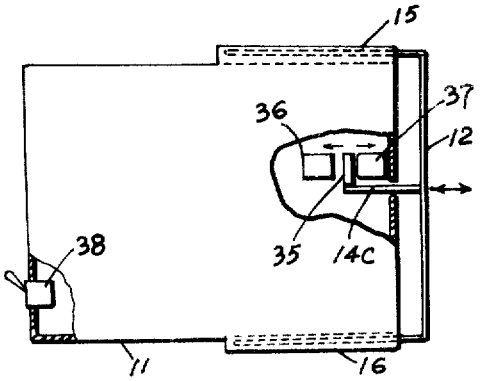
FIG. 9 is a view of a modification of FIG. 1, showing an electromagnetic device for actuating the U-shaped shield with part of the outer case removed and electrical wiring omitted for viewing clarity.

In FIG. 9, a link 14C similar to 14A in FIG. 1, secured at the mid portion of the U-shaped shield, has an iron piece 35 which is freely located between two electromagnetic devices 36 and 37 which are mounted on the outer case 11 rear portion. A double-throw type switch 38 with three positions at front panel is electrically connected to the electromagnetic devices 36 and 37 in individual wiring circuit for controlling the power supply.

FIG. 9 shows the switch 38 in the up position, the electromagnetic device 37 is energized and the iron piece 35 is attracted thereto to push the U-shaped shield 12 to a rearward position and to open the ventilation slots on the outer case 11 rear portion. When the switch 38 is actuated to the down position, the electromagnetic device 36 is energized and the iron piece 35 is attracted thereto and pulls the shield 12 to a forward position to close the ventilation slots on the outer case 11 rear portion.

The switch 38 is preferrably a momentary type which is momentary at each side position and normally stays at the center off position. When it is actuated to the up or down position the correspondent electromagnetic device is energized, but when it is released it automatically returns to the center off position. This will prevent the electromagnetic device from being energized for a long time. Direct current power is preferred for energizing the electromagnetic device, however power can be supplied from an alternating current power source by using a rectifier.

(7) The shield article can also be modified to be rollable sheets installed at both sides and the rear side of the outer case 11 rear ventilation portion, with motor driving means provided thereon. The rollable sheets can be rolled up at upper position or one side for opening the ventilation on the outer case 11 rear portion, and rolled out for closing the ventilation. A power switch at front control panel is provided for controlling the motor running clockwise and counterclockwise, with limit switches at each travel end of the rollable sheet for limiting the rolling travel. Simple cases are shown in FIG. 10 and FIG. 11.

Figure 10:
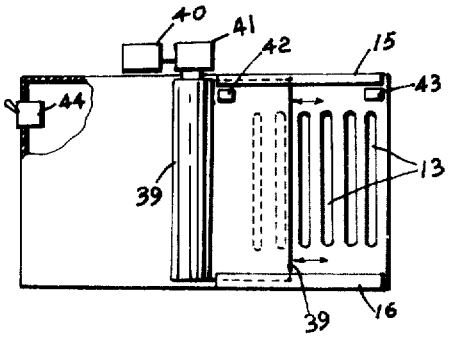
FIG. 10 is also a view of a modification of FIG. 2, showing a rollable shield member replacing the U-shaped shield, and electrical actuating means replacing the manual means, with the other sides similar installations omitted and the partial outer case removed for viewing clarity; and, FIG. 11 is a top elevational view of a modification of FIG. 10 showing the invention with a rollable shield member and electrical power means.

FIG. 10 shows a modification of FIG. 2 in which the U-shaped shield 12 modified by a type of flexible shield sheet 39, preferably sheet metal, which is rolled up and rolled out by a reversible motor 40 through a conventional linkage mechanism 41. The upper and lower flanges of the flexible shield sheet 39 are sliding in the upper and lower slideways 15 and 16. The sliding travel is limited at a desired range by two limit switches 42 and 43 which are mounted on the outer case 11. Power supplied to the motor 40 is controlled by a switch 44 at the front panel. The electrical control circuits of the switch 44 is similar to the switch 34 in FIG. 8.

FIG. 10 shows the switch 44 at the up position, the motor 40 and the linkage mechanism 41 drive the rolling out of the rollable shield sheet 39, which as shown partially closes the ventilation slots 13 on the outer case 11. The closed ventilation slots are shown in dotted lines. As the shield sheet terminal reaches to the limit switch 43 which is then actuated to off position, the power supply circuit is opened and the motor is stopped, and the shield sheet then covers all the ventilation slots. When the switch 44 is actuated to the down position, the motor 40 and linkage mechanism 41 rotate reversely and drive the flexible shield sheet 39 to roll the sheet 39 up. As the shield sheet terminal retracts to the limit switch 42 which is then actuated to the off position, the motor is stopped, and the ventilation slots 13 on the outer case 11 are then all opened.

Figure 11:
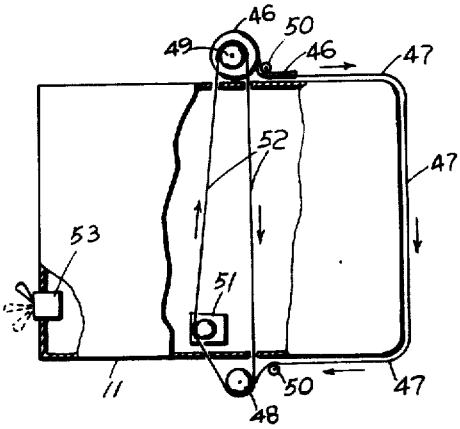
Figure 3:
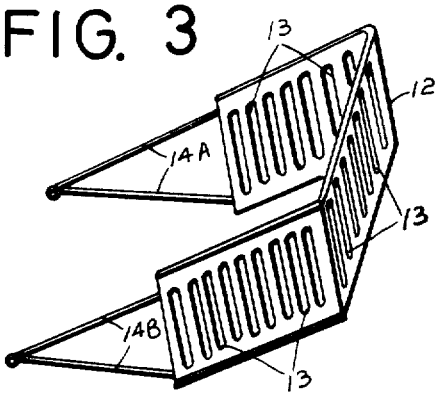
FIG. 3 is a view in perspective of the U-shaped case alone with links at its sides.

The details of an embodiment similar to that shown in FIG. 10 are further described with the aid of FIG. 11. In FIG. 11, is shown a type of flexible shield sheet 46 which is rollable around the outer case 11 rear ventilation portion along level way; one end is linked to strand or rope 47 which is tied to and wound on roller 48, and the other end is tied to and wound on roller 49. The two rollers are located at two ends of the ventilation portion. Two guides 50 at both ends guide the flexible shield 46 and rope 47 to keep them in close contact with the outer case 11. More guides may be provided along the outer case rear portion for firmly guiding and for resisting wind. The rollers 48 and 49 are reversibly drived by a belt 52 or the like which is initially driven by an electromechanical rotary actuator 51. The rotary actuator 51 is a rotating power unit. Its inside limit switches are so adjusted to have a certain rotation or angular travel, clockwise and counterclockwise, sufficient to wind up or wind out the shield sheet 46 for opening and closing the outer case rear portion respectively. Switch 53 with three positions, double-throw type, at the front panel is electrically connected to each direction wiring assembly of the actuator from a power source.

As shown in FIG. 11, the shield 46 is completely wound up on the roller 49, and the outer case rear portion is open, only the rope 47 is therearound. When the switch 53 is turned to the closed position, the actuator 51 drives the belt 52 clockwise, indicated by the arrows, both rollers 48 and 49 are rotated. The shield sheet 46 is released from the roller 49 while the rope 47 is wound up on the roller 48. The shield sheet is then pulled horizontally along the outer case rear portion, as indicated by the arrows. Due to the diameters of the two rollers are varying by winding up and out oppositely with same angular speed rotating, the released shield sheet from roller 49 is longer than that the rope be wound up on roller 48. So at beginning, the shield sheet on the mid way is loose. Then as they are going on, the diameter of the roller 48 is gradually increasing, from smaller to larger than that of the roller 49. Then the length of the rope being wound up on the roller 48 is more than that of the shield sheet being wound out from the roller 49. At last when the shield sheet reaches to the roller 48, it is in tight condition, and the presetting rotary actuator 51 is just stopped. The reverse winding is similarly accomplished.

It is understood that (1) the motor and the limit switches in FIGS. 8 and 10 can also be replaced by an electromechanical actuator, as 51 in FIG. 11. The electromechanical actuator is an assembly of motor, switches, gears and cams for either rotary or linear motion within a presetting range, wherein the rotary motion unit is called a rotary actuator and linear motion unit is called a linear actuator, both are conventional articles. (2) the master link 21B and link 14C in FIGS. 8 and 9 can be modified to two sets or pairs for actuating evenly; (3) the electrical operating means described in FIG. 8 can also apply to FIGS. 1 and 7 with a little change.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a window air conditioner having a radiator and a fan compartment, the improvement comprising:

a case, having an outer case rear portion and an outer case front portion, enclosing said radiator and said fan compartment, said outer case rear portion having a plurality of identical elongated casing ventilation passageways for admitting outside air into said casing, each of said passageways separated by a distance equal to the width of said elongated passageway;

a ventilation shield member movably mounted on said outer casing, said shield member having a plurality of shield ventilation passageways for admitting outside air through said shield member, each of said shield ventilation passageways corresponding to a particular casing ventilation passageway and comparably dimensioned relative thereto; and, moving means for manually moving said shield member relative to said outer case rear portion from a first position in which said shield member blocks said casing ventilation passageways to a second position in which said shield and said casing ventilation passageways overlap, said shield member moving said distance between adjacent ventilation passageways from said first to said second position, said moving means including an operating handle mounted at said outer case front portion;

whereby ventilating air enters said casing through said shield and said casing ventilation passageways when said shield member is in said second position, said shield member closing said casing to outside air, and in the event of windy weather precluding sand and dust from blowing into said air conditioner, when said shield member is in said first position.

2. The air conditioner recited in claim 1, wherein said shield member comprises:

a U-shaped double case slidable in a horizontal direction in the vicinity of said outer case rear portion, said U-shaped case having ventilation passageways which are disposed so that when said U-shaped case slides to a forward limit position said shield member blocks said casing ventilation passageways, and when said U-shaped case slides to a rear limit position, said shield and said casing ventilation passageways completely overlap.

3. The air conditioner recited in claim 1, wherein:

said shield member comprises pivotable door-like articles at said outer case rear portion, which are simultaneously operated by said moving means; and wherein, said moving means further comprises linkage means coupling said handle to said door-like article, said linkage mechanism pivoting clockwise and counterclockwise for respectively opening said casing ventilation passageways to outside air through said shield ventilation passageways when said handle is in said second position, and for blocking said casing ventilation passageways by said shield member when said handle is in said first position.

4. In a window air conditioner having a radiator and a fan compartment, the improvement comprising:

a case having an outer case rear portion and an outer case front portion, said outer case rear portion enclosing said radiator and said fan compartment and having a plurality of identical elongated casing ventilation passageways for admitting outside air into said casing, each of said passageways separated by a distance equal to the width of said elongated passageway;

a ventilation shield member movably mounted on said outer casing, said shield member having a plurality of shield ventilation passageways for admitting outside air through said shield member, each of said ventilation passageways corresponding to a particular casing ventilation passageway and comparably dimensioned relative thereto; and moving means for manually moving said shield member relative to said outer case rear portion from a first position in which said shield member completely blocks said casing ventilation passageways to a second position in which ventilation through said casing ventilation passageways is substantially unincumbered, said shield member moving said distance between adjacent ventilation passageways from said first to said second position, said moving means including an operating handle mounted at said outer case front portion;

whereby ventilation air enters said casing through said shield and said casing ventilation passageways when said shield member is in said second position, said shield member closing said casing to outside air, and in the event of windy weather precluding sand and dust from blowing into said air conditioner, when said shield member is in said first position.

5. The air conditioner recited in claim 4, wherein said shield member comprises:

a U-shaped double case slidable in a horizontal direction in the vicinity of said outer case rear portion, said U-shaped case disposed so that when said U-shaped case slides to a forward limit position said shield member blocks said casing ventilation passageways, and when said U-shaped case slides to a rear limit position, said shield member enables ventilation through said casing ventilation passageways.

6. The air conditioner recited in claim 4 wherein said shield member comprises:

a U-shaped double case slidable in a vertical direction in the vicinity of said outer case rear portion, said U-shaped case disposed so that when said U-shaped case slides to a lower limit position said shield member blocks said casing ventilation passageways, and when said U-shaped case slides to an upper limit position, said shield member enables ventilation through said casing ventilation passageways.

7. In a window air conditioner having a radiator and a fan compartment and activated by a main power switch located at a front control panel, the improvement comprising:

an air conditioner case having an outer case rear portion and an outer case front portion, said outer case rear portion enclosing said radiator and said fan compartment and having a plurality of casing ventilation passageways for admitting outside air into said casing, a ventilation shield movably mounted on said outer case rear portion for blocking said ventilation passageways when said shield is in a first closed position and for admitting ventilating air to said outer case rear portion when said shield is in a second open position; and, actuating means operated at the air-conditioner front control panel for moving said shield member between said open and closed positions;

whereby sand and dust are precluded from entering the air conditioner when the shield is in the first position.

8. The air conditioner recited in claim 7, wherein:

said shield comprises pivotable door-like articles at said outer case rear portion, which are simultaneously operated by said moving means; and wherein, said actuating means comprises an operating handle mounted at said outer case front portion, linkage means coupling said handle to said door-like articles, said linkage means pivoting clockwise and counterclockwise for respectively opening said casing ventilation passageways to outside air when said handle is in said second position, and for blocking said casing ventilation passageways by said shield when said handle is in said first position.

9. The air conditioner recited in claim 7 wherein said actuating means further comprises:

an actuating article coupled to said main power switch for actuating the main power switch to on and off positions corresponding to the open and closed positions respectively of the shield, so that as the shield is in the closed or open position, the air conditioner is stopped or working accordingly.

10. The air conditioner recited in claim 7 wherein said actuating means further comprises:

a ventilation switch coupled in series with said main power switch such that when said shield is actuated to the open position, said ventilation switch couples power to said main power switch, and when said shield is in the closed position no power is coupled to said main power switch.

11. The air conditioner recited in claim 7 wherein said actuating means comprises:

a front panel control switch for initiating the movement of said shield; and, means for electrically operating said shield between the open and closed positions.

12. The air conditioner recited in claim 11 wherein said shield comprises a set of flexible plates rollably installed, and wherein said electrically operating means comprises a motor driving assembly connected to said rollable plates, and contact switches at all travel terminals of said rollable plates for limiting travel in all ways.

13. The air conditioner recited in claim 11 wherein said shield comprises iron pieces and wherein said electrical operating means comprises an electromagnetic device to attract or repel the shield iron pieces.

14. A shield assembly comprising a case member and actuating means, wherein:

said case member having movable shield article is to be sleeved and mounted onto existing air conditioner outer case rear portion in matched dimensions; said outer case rear portion encloses fan and radiator compartment and provides with ventilation passageways therearound for adopting outside air circulating therein;

said actuating means comprises an operating handle mounted on said air conditioner outer case front portion, linkage means coupling said operating handle to said case member and said shield article, and moving means for manually moving said shield article relative to said case member from a first position in which said shield article completely blocks said case member whereby completely blocking the air conditioner outer case rear portion ventilation passageways therein, to a second position in which said case member is open and ventilation through said outer case rear portion ventilation passageways is substantially unincumbered;

whereby ventilation air enters said air conditioner outer case rear portion through said shield article on said case member and said casing ventilation passageways when said shield article is in said second position, said shield article closing said case member whereby closing said outer case rear portion therein to outside air, and in the event of windy weather precluding sand and dust from blowing into said air conditioner, when said shield article is in said first position.

15. The shield assembly recited in claim 14 wherein:

said shield article comprises pivotable door-like articles at said case member and are simultaneously operated by said moving means, and said linkage means pivoting clockwise and counterclockwise for respectively opening said case member whereby opening said outer case ventilation passageways to outside air when said handle is in second position, and for blocking said case member whereby blocking said outer case rear portion ventilation passageways by said door-like article when said handle is in said first position.

* * * * *